US009327295B2

(12) United States Patent
Lior et al.

(10) Patent No.: US 9,327,295 B2
(45) Date of Patent: May 3, 2016

(54) CONCENTRATING SUBSTANCES

(75) Inventors: Shai Lior, Rehovot (IL); Avner Schneider, Ness Ziona (IL); Mark Sandler, Rehovot (IL); Yaron Peri, Gedera (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/416,850

(22) PCT Filed: Jul. 24, 2012

(86) PCT No.: PCT/EP2012/064548

§ 371 (c)(1),
(2), (4) Date: Jan. 23, 2015

(87) PCT Pub. No.: WO2014/015900

PCT Pub. Date: Jan. 30, 2014

(65) Prior Publication Data

US 2015/0209800 A1 Jul. 30, 2015

(51) Int. Cl.

| | |
|---|---|
| ***G03G 15/10*** | (2006.01) |
| ***G03G 15/11*** | (2006.01) |
| ***B03C 5/00*** | (2006.01) |
| ***B03C 5/02*** | (2006.01) |

(52) U.S. Cl.

CPC ..... *B03C 5/005* (2013.01); *B03C 5/026* (2013.01); *G03G 15/105* (2013.01); *G03G 15/11* (2013.01)

(58) Field of Classification Search

CPC ..... G03G 15/10; G03G 15/104; G03G 15/11; B03C 5/00; B03C 5/005; B03C 5/026

USPC ..... 399/58, 237, 241, 249

See application file for complete search history.

(56) References Cited

U.S. PATENT DOCUMENTS

| | | | | |
|---|---|---|---|---|
| 3,655,550 | A | 4/1972 | Davies | |
| 3,863,603 | A | 2/1975 | Buckley et al. | |
| 3,959,574 | A | 5/1976 | Seanor et al. | |
| 4,974,027 | A | 11/1990 | Landa et al. | |
| 5,346,796 | A | 9/1994 | Almog | |
| 5,514,269 | A | 5/1996 | Day et al. | |
| 6,987,944 | B2 | 1/2006 | Shakuto et al. | |
| 7,643,766 | B2 | 1/2010 | Horiuchi et al. | |
| 2006/0021226 | A1 | 2/2006 | Cormier et al. | |
| 2010/0172675 | A1 * | 7/2010 | Mizumoto | G03G 15/0818 399/286 |
| 2011/0266347 | A1 * | 11/2011 | Grinwald | C09D 11/52 235/451 |
| 2014/0199627 | A1 * | 7/2014 | Sandler | G03G 15/104 430/137.22 |

FOREIGN PATENT DOCUMENTS

| | | |
|---|---|---|
| EP | 1429205 | 6/2004 |
| JP | 04-253061 A * | 9/1992 |
| JP | H05142950 | 6/1993 |
| JP | 2003520997 | 7/2003 |
| JP | 2004118099 | 4/2004 |
| JP | 2009053405 | 3/2009 |
| JP | 2011221329 | 11/2011 |
| WO | WO 01/53895 | 7/2001 |
| WO | WO-2007130069 | 11/2007 |

* cited by examiner

*Primary Examiner* — Sophia S Chen
(74) *Attorney, Agent, or Firm* — Dierker & Associates, P.C.

(57) ABSTRACT

The present disclosure relates to a method for concentrating a substance, which may be an electrostatic printing ink. An apparatus for concentrating a substance is also described.

15 Claims, 1 Drawing Sheet

CONCENTRATING SUBSTANCES

BACKGROUND

In general, electrostatic printing processes involve creating an image on a photoconductive surface, applying an ink having charged particles to the photoconductive surface, such that they selectively bind to the image, and then transferring the charged particles in the form of the image to a print substrate.

The photoconductive surface is typically on a cylinder and is often termed a photo imaging plate (PIP). The photoconductive surface is selectively charged with a latent electrostatic image having image and background areas with different potentials. For example, an electrostatic ink composition comprising charged toner particles in a liquid carrier can be brought into contact with the selectively charged photoconductive surface. The charged toner particles adhere to the image areas of the latent image while the background areas remain clean. The image is then transferred to a print substrate (e.g. paper) directly or, more commonly, by being first transferred to an intermediate transfer member, which can be a soft swelling blanket, and then to the print substrate. Variations of this method utilize different ways for forming the electrostatic latent image on a photoreceptor or on a dielectric material.

DETAILED DESCRIPTION

Figure 1:
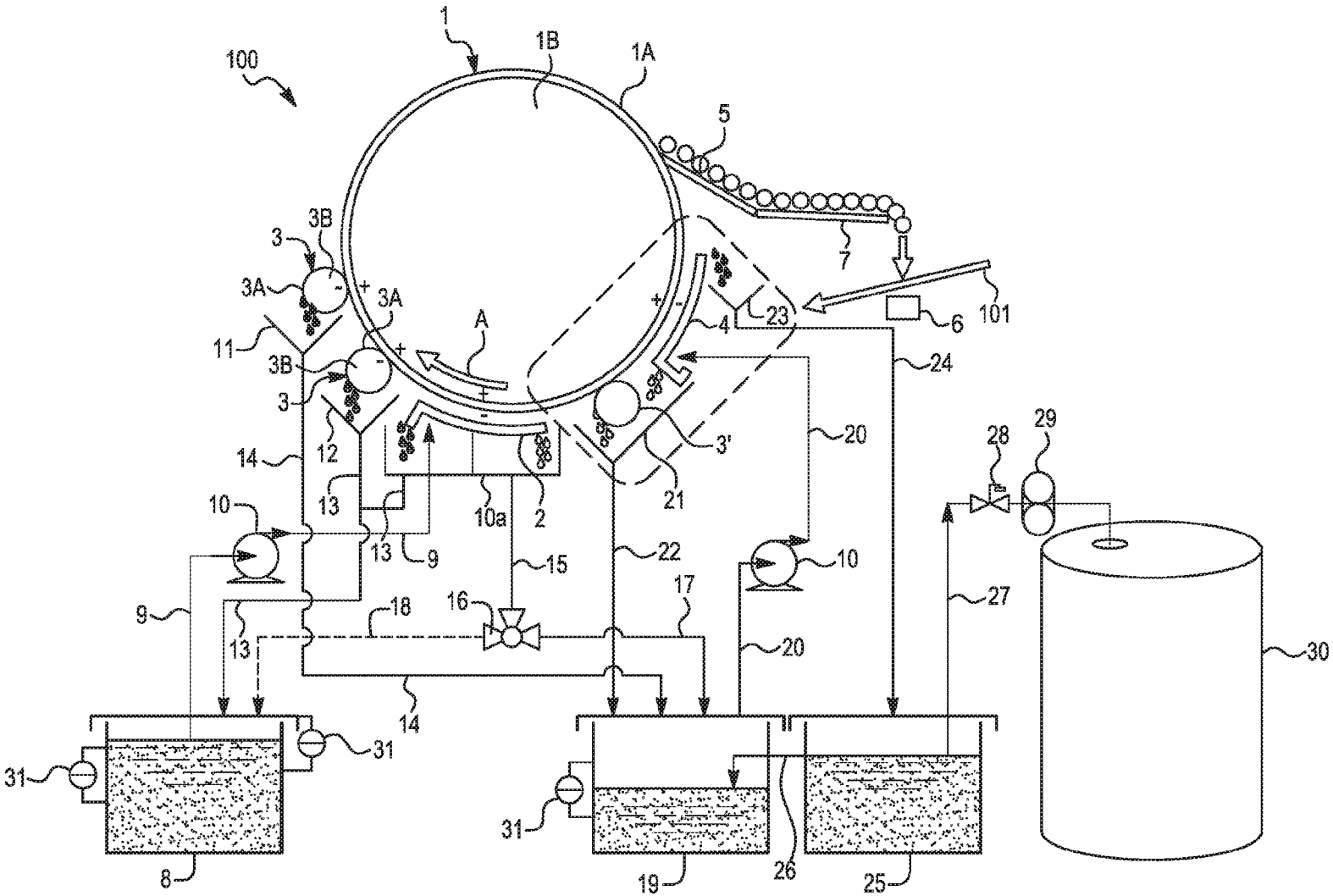
FIG. 1 shows an example of an apparatus for concentrating a substance, e.g. an electrostatic ink composition, and for carrying out examples of the method described herein.

Before examples of the present invention are disclosed and described, it is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited by the appended claims and equivalents thereof.

It is noted that, as used in this specification and the appended claims, the singular forms "a," "an," and "the" include plural referents unless the context clearly dictates otherwise.

As used herein, "liquid carrier", "carrier liquid," "carrier," or "carrier vehicle" refers to the fluid in which the polymers, particles, colorant, charge directors and other additives can be dispersed to form a liquid electrostatic ink or electrophotographic ink. Typical carrier liquids can include a mixture of a variety of different agents, such as surfactants, co-solvents, viscosity modifiers, and/or other possible ingredients.

As used herein, "electrostatic ink composition" generally refers to a ink composition, which may be in liquid form, that is typically suitable for use in an electrostatic printing process, sometimes termed an electrophotographic printing process.

As used herein, "pigment" generally includes pigment colorants, magnetic particles, aluminas, silicas, and/or other ceramics or organo-metallics, whether or not such particulates impart color. Thus, though the present description exemplifies the use of pigment colorants, the term "pigment" can be used more generally to describe not only pigment colorants, but other pigments such as organometallics, ferrites, ceramics, etc.

As used herein, "copolymer" refers to a polymer that is polymerized from at least two monomers.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly or indirectly via an intermediate transfer member to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involves subjecting the electrostatic ink composition to an electric field, e.g. an electric field having a field gradient of 1000 V/cm or more, e.g. an electric field having a field gradient of 1500 V/cm or more.

"Concentrating" a substance (e.g. electrostatic ink composition) as described herein may indicate increasing the solids content, e.g. in wt % terms, of the substance (e.g. electrostatic ink composition). This may involve increasing the concentration of the solids in the substance (e.g. electrostatic ink composition).

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Further-more, such an interpretation should apply regardless of the breadth of the range or the characteristics being described.

Unless otherwise stated, any feature described herein can be combined with any aspect or any other feature described herein.

In some instances, after a substance (e.g. an electrostatic ink composition) has been made and before it is used, for example in printing, it may be concentrated and then packaged. It may be then transported from the site of production to a site of use, e.g. where it may be used, for example in printing if it is an electrostatic ink composition.

In a first aspect, there is provided a method for concentrating a substance. The method may comprises the steps of:

(a) providing the substance, the substance comprising chargeable particles in a liquid carrier;

(b) passing the substance between a conveyor and a first electrode, wherein a potential is applied between the conveyor and the first electrode such that the substance becomes adhered to the conveyor, and wherein some liquid carrier may be removed from the substance on the conveyor;

(c) passing the substance on the conveyor past a moving surface, wherein the substance contacts the moving surface and a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated substance on the conveyor, the conveyor and the moving surface then diverging from one another;

(d) removing at least some of the concentrated substance from the conveyor. In some examples, the method may further comprise the step:

(e) wherein at least some of the liquid carrier removed from the conveyor in step (b) or step (c) is passed between a second electrode and the conveyor, and a potential is applied between the conveyor and the second electrode such that the chargeable particles are disposed to move toward the conveyor, and some liquid carrier is removed.

In a second aspect, there is provided an apparatus for concentrating a substance. The apparatus may be suitable for and/or adapted to carry out the method disclosed herein. The apparatus may comprise a conveyor, a first electrode, a moving surface, a concentrated substance removal means, and, in some examples, a second electrode. The apparatus may be adapted to carry out a method comprising the steps of:

(a) passing the substance between the conveyor and the first electrode, wherein the substance comprises chargeable particles in a liquid carrier, and a potential is applied between the conveyor and the first electrode such that the substance becomes adhered to the conveyor, and some liquid carrier may be removed from the substance on the conveyor;

(b) passing the substance on the conveyor past the moving surface, wherein the substance contacts the moving surface and a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated substance on the conveyor, the conveyor and the moving surface then diverging from one another, such that at least some of the concentrated substance remains on the conveyor;

(c) removing at least some of the concentrated substance from the conveyor by the concentrated substance removal means. In some examples the method may further comprise the step (d)

(d) wherein at least some of the liquid carrier that is removed from the conveyor in step (a) or step (b) is passed between a second electrode and the conveyor, wherein a potential is applied between the conveyor and second electrode such that the chargeable particles are disposed to move toward the conveyor, and some carrier liquid is removed.

In some examples, the second electrode is stationary relative to the conveyor, and is separated by a gap through which liquid carrier is passed in step (e), and in at least part of the region of the gap, has a shape that corresponds to the shape of the nearest surface of the conveyor.

In some examples, a gap is provided between the second electrode and conveyor, and the liquid carrier in step (e) of the first aspect or step (d) of the second aspect is fed into the gap in a direction substantially opposite to the direction of movement of the conveyor past the second electrode.

In some examples, a liquid carrier is collected after it has traveled the length of the electrode in a direction opposite to the direction of movement of the conveyor past the second electrode.

In some examples, a potential difference applied between the conveyor and the second electrode is 500 V to 6000 V.

In some examples, the shortest distance between the second electrode and the conveyor is from 0.5 to 2 mm.

In some examples, the substance is an electrostatic ink composition comprising the chargeable particles in the liquid carrier.

In some examples, liquid carrier removed from the conveyor in step (b) or step (c) in the method of the first aspect (or step (a) and (b) in the second aspect) is passed between a second electrode and the conveyor if it has a solids content at or below a threshold value.

In some examples, a plurality of moving surfaces are provided in series at or near the outer surface of the conveyor, and each moving surface forms part of a moving body in the form of a rotatable drum, and wherein the liquid carrier removed from the drum closest to the first electrode is recirculated to the first electrode, and at least some of the liquid carrier removed from the other drum or drums is passed between the second electrode and the conveyor in step (e). In some examples, each of the plurality of drums has a metal core with an outer surface layer comprising an elastomeric material.

In some examples, the conveyor is or comprises a rotatable drum in the form of a cylinder. In some examples, the drum comprises a metal core having a surface covering of a non-metallic, elastomeric or non-elastomeric material. In some examples, the drum comprises an aluminium core, which has a Type III anodised surface covering.

In some examples, the chargeable particles comprise a resin comprising a polymer that is a copolymer of ethylene or propylene and an ethylenically unsaturated acid of either acrylic acid or methacrylic acid.

Substance to be Concentrated

The substance may comprise chargeable particles in a liquid carrier. In some examples, the substance is an electrostatic ink composition. The chargeable particles may comprise a resin. In some examples, the substance, e.g. an electrostatic ink composition, comprises the liquid carrier and particles comprising a resin and a colorant. The chargeable particles may be suspended in the liquid carrier.

A chargeable particle may be a toner particle suitable for use in an electrostatic printing process. A chargeable particle may be capable of undergoing electrophoresis in an electric field. A chargeable particle may have a charge, e.g. of negative or positive polarity, or be capable of developing a charge when placed in an electric field gradient. The chargeable particles may be capable of developing a charge from the nature of the resin, e.g. if the resin has acidic side groups. In some examples, the substance (e.g. electrostatic ink composition) may comprise a charge director.

The resin may include a thermoplastic polymer. In particular, the polymer of the resin may be selected from ethylene acrylic acid copolymers; ethylene methacrylic acid copolymers; ethylene vinyl acetate copolymers; copolymers of ethylene (e.g. 80 wt % to 99.9 wt %) and alkyl (e.g. C1 to C5) ester of methacrylic or acrylic acid (e.g. 0.1 wt % to 20 wt %); copolymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g. copolymer of acrylic or methacrylic acid and at least one alkyl ester of acrylic or methacrylic acid wherein alkyl may be from 1 to about 20 carbon atoms, such as methyl methacrylate (e.g. 50 wt % to 90 wt %)/methacrylic acid (e.g. 0 wt % to 20 wt %)/ethylhexylacrylate (e.g. 10 wt % to 50 wt %)); ethylene-acrylate terpolymers:ethylene-acrylic esters-maleic anhydride (MAH) or glycidyl methacrylate (GMA) terpolymers; ethylene-acrylic acid ionomers and combinations thereof.

In some examples the resins comprise a copolymer of ethylene or propylene (e.g. 80 wt % to 99.9 wt %) and methacrylic or acrylic acid (e.g. 0.1 wt % to 20 wt %). In some examples, the resin comprises a first polymer that is a copolymer of ethylene or propylene and an ethylenically unsaturated acid of either acrylic acid and methacrylic acid. In some examples, the first polymer is absent ester groups and, in some examples, the resin further comprises a second polymer having ester side groups. The second polymer having ester side groups may be a co-polymer of (i) a first monomer having ester side groups selected from esterified acrylic acid or esterified methacrylic acid, (ii) a second monomer having acidic side groups selected from acrylic or methacrylic acid and (iii) a third monomer selected from ethylene and propylene.

In step (a) of the first or second aspect, the resin may constitute 5% to 99% by weight of the solids in the substance (e.g. electrostatic ink composition), in some examples 50% to 90% by weight of the solids of the substance (e.g. electrostatic ink composition), in some examples 70% to 90% by weight of the solids of the substance (e.g. electrostatic ink composition). The remaining wt % of the solids in the substance (e.g. electrostatic ink composition) may be a colorant and, in some examples, any other additives that may be present.

Generally, the liquid carrier acts as a dispersing medium for the other components in the substance (e.g. electrostatic ink composition). In some examples, the liquid carrier can comprise or be a hydrocarbon, silicone oil, vegetable oil, etc. The liquid carrier can include, but is not limited to, an insulating, non-polar, non-aqueous liquid that cab be used as a medium for toner particles. The liquid carrier can include compounds that have a resistivity in excess of about $10^9$ ohm-cm. The liquid carrier may have a dielectric constant below about 5, in some examples below about 3. The liquid carrier can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the liquid carriers include, but are not limited to, aliphatic hydrocarbons, isoparaffinic compounds, paraffinic compounds, dearomatized hydrocarbon compounds, and the like. In particular, the liquid carriers can include, but are not limited to, Isopar-G™, Isopar-H™, Isopar-L™, Isopar-M™, Isopar-K™, Isopar-V™, Norpar 12™, Norpar 13™ Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™ Nisseki Isosol 400™ AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

In some examples, the liquid carrier, in step (a) in the first or second aspect, constitutes about 20 to 99.5% by weight of the substance (e.g. electrostatic ink composition), in some example 50 to 99.5% by weight of the substance (e.g. electrostatic ink composition). In some examples, the liquid carrier, in step (a) in the first or second aspect, constitutes about 40 to 90% by weight of the substance (e.g. electrostatic ink composition). In some examples, in step (a) in the first or second aspect, the liquid carrier constitutes about 60 to 80% by weight of the substance (e.g. electrostatic ink composition). In some examples, in step (a) in the first or second aspect, the liquid carrier may constitute about 90 to 99.5% of the substance (e.g. electrostatic ink composition), in some examples 95 to 99% of the substance (e.g. electrostatic ink composition). In some examples, the remaining wt % of the ink composition is formed from the particles comprising a resin and a colorant, and, in some examples, any other additives that may be present.

The colorant may be a dye or pigment. The particles may comprise a pigment. The colorant may be any colorant compatible with the liquid carrier and useful for electrostatic printing. For example, the colorant may be present as pigment particles, or may comprise a resin (in addition to the polymers described herein) and a pigment. In some examples, the colorant is selected from a cyan pigment, a magenta pigment, a yellow pigment and a black pigment. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM® YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE® YELLOW 5GT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN®

GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200.

The substance (e.g. electrostatic ink composition) may include a charge director. A charge director can be added to the liquid carrier to impart a charge of positive or negative polarity on the particles and/or maintain sufficient electrostatic charge on the particles. In some examples, the charge director can include nanoparticles of a simple salt and a sulfosuccinate salt of the general formula MAn, wherein M is a metal, n is the valence of M, and A is an ion of the general formula [R1-O—C(O)CH2CH(SO3-)OC(O)—O—R2], where each of R1 and R2 is an alkyl group, or other charge component as found in WO2007130069, which is incorporated herein by reference in its entirety. In some examples, the charge director compounds be selected from ionic compounds, which may in turn be selected from metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols. The charge director used herein may be as described in U.S. Pat. No. 5,346,796, which is incorporated herein by reference in its entirety.

The charge director may comprise (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In some examples, the charge director constitutes about 0.001% to 20%, in some examples 0.01 to 20% by weight, in some examples 0.01 to 10% by weight, in some examples 0.01 to 1% by weight of the solids of the substance (e.g. electrostatic ink composition). In some examples, the charge director constitutes about 0.001 to 0.15% by weight of the solids of the substance (e.g. electrostatic ink composition), in some examples 0.001 to 0.15%, in some examples 0.001 to 0.02% by weight of the solids of the substance (e.g. electrostatic ink composition).

The amounts of charge director described herein may relate to the total amount of charge director in the substance (e.g. electrostatic ink composition). In some examples, a plurality of types of charge director may be included in the substance (e.g. electrostatic ink composition) and the amounts are the sum of the different types of charge director in the substance (e.g. electrostatic ink composition).

In some examples, the substance (e.g. electrostatic ink composition) contains less than 0.3 mg of charge director per g of solids in the substance (e.g. electrostatic ink composition). In some examples, the substance (e.g. electrostatic ink composition) contains less than 0.2 mg of charge director per g of solids in the substance (e.g. electrostatic ink composition), in some examples less than 0.1 mg, in some examples less than 0.05 mg charge director per g of solids in the substance (e.g. electrostatic ink composition). In some examples, the substance (e.g. electrostatic ink composition) is substantially free or free of charge director, which may be as defined above.

The electrostatic ink composition may comprise one or more additives, for example a charge adjuvant, a wax, a surfactant, biocides, organic solvents, viscosity modifiers, materials for pH adjustment, sequestering agents, preservatives, compatibility additives, emulsifiers and the like.

Conveyor

The conveyor may be any suitable conveyor that can support and move the substance (e.g. electrostatic ink composition), and to which a potential can be applied. The conveyor may be termed a chargeable conveyor herein. When charged, i.e. when a potential is applied between the chargeable conveyor and the electrode, the conveyor is adapted so that the particles adhere to the conveyor.

The conveyor will typically have a continuous surface that forms a loop. In some examples, the conveyor is in the form of rotatable drum, the outer surface of which acts to support the substance (e.g. electrostatic ink composition). The drum may rotate on an axis, which may be orientated at any desired angle. In some examples, the axis of the drum is on the horizontal. The drum may be any suitable shape, and in some examples is cylindrical, with the axis of rotation forming the axis of the cylinder.

In some examples, the conveyor is in the form of a belt that is driven by a suitable mechanism, such as one or more rollers.

The conveyor may comprise a metal. The metal may be selected from, but is not limited to, steel, aluminium and copper, and alloys including any of these metals. The conveyor may comprise a metal substrate, which may be in the form of a drum, having a surface covering of a non-metallic material, which may be a non-metallic, elastomeric or non-elastomeric material. Non-metallic, non-elastic materials may be selected from metal oxides and carbon-containing coatings, such as a diamond-like carbon coating. The elastomeric material may comprise a material selected from chloroprene rubber, isoprene rubber, EPDM rubber, polyurethane rubber, epoxy rubber, butyl rubber, fluoroelastomers (such as the commercially available Viton) and polyurethane. The elastomeric material may further comprise a resistivity control agent, which may be dispersed in the elastomeric material, and the resistivity control agent may be selected from an ionic material, a metal or carbon. The ionic material may be a quaternary ammonium compound. The resistivity control agent, which may be dispersed in the elastomeric material, may be selected from organic dyes, organic pigments, organic salts, polyelectrolytes, inorganic salts, plasticisers, inorganic pigments, metallic particles, charge transfer complexes or materials which produce charge transfer complexes with the elastomeric material, e.g. polyurethane. The resistivity control agent may be present in an amount of 0.1 to 6 wt % of the surface covering, while the remaining wt percentage may be the elastomeric material. The resistivity control agent may be a quaternary ammonium compound, for example a compound of the formula (NR1'R2'R3'R4)X', in which $R^{1'}$, $R^{2'}$ $R^{3'}$ and $R^4$ are each independently hydrocarbon groups, including, but not limited to, alkyl or aryl groups, and wherein the alkyl is substituted or unsubstituted, branched or straight-chain, saturated or unsaturated, and X' is an anion, such as a halide. Examples of quaternary ammonium compounds include, but are not limited to, tetraheptyl ammonium bromide, trimethyloctadecylammonium chloride, benzyltrimethylammonium chloride. In some examples, the resistivity control agent is a lithium salt.

The conveyor may comprise a metal substrate, which may be in the form of a drum, having a surface covering of a metal oxide, and the metal of the metal substrate and that of the metal oxide may be the same. In some examples, the surface covering may have a thickness of at least 5 μm, in some examples at least 10 μm, in some examples, at least 15 μm, in some examples at least 25 μm. In some examples, the surface covering may have a thickness of from 5 μm to 100 μm, in some examples from 20 to 80 μm, in some examples from 30 to 70 μm, in some examples from 45 to 60 μm. In some examples, the conveyor comprises a metal substrate having an anodised surface coating of a metal oxide, in some examples having a thickness of at least 5 μm, in some examples at least 10 μm, in some examples at least 15 μm, in some examples at least 25 μm. In some examples, the conveyor comprises a metal substrate having an anodised surface coating of a metal oxide having a thickness of from 5 μm to 100 μm, in some examples from 20 to 80 μm, in some examples from 30 to 70 μm, in some examples from 45 to 60 μm. In some examples, the conveyor comprises an aluminium substrate having an anodised surface coating comprising an aluminium oxide. In some examples, the anodised surface coating is a Type III anodised coating, sometimes termed in the art as an anodised hardcoat, a coating formed by hard anodising or by engineering anodising. Methods for carrying out Type III or hard anodising are described in the art, and standards for such anodising can be found, for example, in MIL-A-8625 Type III, AMS 2469H, BS ISO 10074:2010 and BS EN 2536:1995, the specifications of which are all incorporated herein by reference in their entirety. The present inventors have found that hard anodizing a surface of the metal conveyor produces a conveyor with a favourable resistivity that is able to suitably control charge transfer from the conveyor to the particles of the substance (e.g. electrostatic ink composition).

The conveyor may be of any suitable size. In some examples, the conveyor has a width, measured in a direction across its surface perpendicular to the direction of movement of its surface of at least 40 cm, in some examples at least 50 cm, in some examples at least 60 cm, in some examples at least 70 cm, in some examples at least 1 m, in some examples at least 2 m, in some examples at least 3 m, in some examples from 40 cm to 4 m, in some examples from 200 cm to 400 cm, in some examples from 250 cm to 350 cm. In some examples, the conveyor is or comprises a rotatable drum in the form of a cylinder that has a width, measured in a direction across its surface perpendicular to the direction of movement of its surface (i.e. parallel to the axis of the cylinder) of at least 40 cm, in some examples at least 50 cm, in some examples at least 60 cm, in some examples at least 70 cm, in some examples at least 1 m, in some examples at least 2 m, in some examples at least 3 m, in some examples from 40 cm to 4 m, in some examples from 200 cm to 400 cm, in some examples from 250 cm to 350 cm. In some examples, the conveyor is or comprises a rotatable drum in the form of a cylinder that has a diameter, of at least 40 cm, in some examples at least 50 cm, in some examples at least 60 cm, in some examples at least 70 cm, in some examples at least 1 m, in some examples at least 2 m, in some examples from 40 cm to 3 m, in some examples from 100 cm to 300 cm, in some examples from 250 cm, to 350 cm. In some examples, the ratio of width of the cylinder: diameter of cylinder is 2:1 to 1:2.

The conveyor may have a surface with a resistivity of about $1\times10^{9}$ to $1\times10^{11}$ Ohm*cm, or in some examples a resistivity of about $1\times10^{10}$ Ohm*cm.

First Electrode

The first electrode can be any suitable electrode capable of applying a potential between the conveyor and the first electrode. The electrode may be stationary relative to the conveyor. The first electrode may have a shape that, at least in part, corresponds to the shape of at least part of the conveyor. For example, if the conveyor is a cylinder having an axis, the electrode may have a cross section that forms part of a circle, the centre of this circle being the same as that for the cylinder. In some examples, if the conveyor is a cylinder having an axis, the electrode may have an inner surface that forms part of a cylinder shape, the axis of this cylinder shape being the same as that for the cylinder of the conveyor.

In some examples, the shortest distance between the first electrode and the conveyor is from 0.5 mm to 5 mm, in some examples from 0.5 to 2 mm, in some examples from 0.8 mm to 1.2 mm.

In some examples, the first electrode may be in the form of a roller or a belt, having a surface that can move in the same direction as the surface of the conveyor, and may contact the surface of the conveyor. If the first electrode is in the form of a roller, e.g. a cylinder, and the conveyor is in the form of a drum, the roller of the first electrode may have a diameter that is less than the diameter of a roller or drum of the conveyor. In some examples, a plurality of first electrodes in the form of rollers and/or belts, e.g. as described above, may be disposed around the conveyor, and, in use, each may be used to adhere the chargeable particles, which may comprise a resin as described herein, to the conveyor.

The electrode may comprise any electrically conducting material, including, but not limited to, a metal and carbon. The electrode may comprise a metal selected from copper, aluminium and steel.

In the method, a potential is applied such that the substance (e.g. electrostatic ink composition) becomes adhered to the conveyor. The potential difference between the conveyor and the first electrode may be 500 V or more, in some examples 1000 V or more, in some examples 2000 V or more, in some examples 3000 V or more, in some examples 3200 V or more, in some examples 3500 V or more, in some examples 3800 V or more, in some examples 4000 V or more. The potential difference between the conveyor and the first electrode may be from 500 V to 7000V, in some examples 1000 V to 7000 V, in some examples 3000 V to 6000 V, in some examples 3000V to 4000 V. The conveyor may be at a potential more positive than the first electrode or the conveyor may be at a potential less positive than the first electrode. In some examples, the potential of the conveyor may be at or close to, e.g. within 50 V of, ground (0 V).

In the method, the surface of the conveyor may travel at a speed of from 1 to 100 cm/sec, or in some examples 5 to 70 cm/sec, or in some examples 10 to 50 cm/sec, or in some examples 20 to 50 cm/sec, or in some examples 30 to 50 cm/sec.

The electric field between the conveyor and the first electrode may be 500 V/mm or more, in some examples 1000 V/mm or more, in some examples 1500 V/mm or more, in some examples 2000 V/mm or more, in some examples 2500 V/mm or more, in some examples, 2800 V/mm or more, in some examples 2900 V/mm or more, in some examples 3000 V/mm or more, in some examples, 3200 V/mm or more, in some examples 3500 V/mm or more, in some examples 3800 V/mm or more, in some examples 4000 V/mm or more. The electric field between the conveyor and the first electrode may be from 500 V/mm to 6000 V/mm, in some examples from 1000 V/mm to 6000 V/mm, in some examples from 1500 V/mm to 6000 V/mm, in some examples from 2000 V/mm to 6000 V/mm, in some examples from 2500 V/mm to 5000 V/mm, in some examples 2800 V/mm to 4700 V/mm, in some examples 2900 V/mm to 4600 V/mm, in some examples 2900 V/mm to 4500 V/mm, in some examples 2900 V/mm to 4200 V/mm. The present inventors have found that if the particles are passed through a high electric field, this promotes their charging, and fields of 3000 V/mm or more have been found to be particularly effective in promoting charging of the particles, even when the substance (e.g. electrostatic ink composition) lacks a charge director.

The first electrode may be positioned below the conveyor, with a separation between the first electrode and conveyor forming a gap. The method may be such that the substance (e.g. electrostatic ink composition) fills, at least partially, the gap between the conveyor and the first electrode, and the potential in step (b) is applied such that the substance (e.g. electrostatic ink composition) becomes adhered to the conveyor. Fluid seals may be provided at the lateral edges of gap.

In some examples the gap between the conveyor and the first electrode has a first exit and second exit, out of both of which the substance can flow after being passed into the gap, and the first exit is located downstream in the direction of travel of the conveyor from the second exit. In some examples, the substance (e.g. in step (b) in the first aspect or step (a) in the second aspect) is passed into the gap downstream, in the direction of travel of the conveyor, from the second exit, and, in some examples, at or near the first exit. In some examples, liquid carrier that exits the gap at the first exit is recycled back to the first electrode, and passed between the first electrode and the conveyor (e.g. at step (a) in the first aspect). In some examples, liquid carrier that exits the gap at the second exit is transferred to the second electrode, and passed between the second electrode and the conveyor, e.g. in step (e) of the method of the first aspect or step (d) of the second aspect.

In some examples, the first electrode comprises a roller, which is positioned below the conveyor, and in a reservoir for the substance (e.g. electrostatic ink composition) to be concentrated (e.g. in step (a)). In some examples, the first electrode comprises a plurality of rollers, which are positioned below the conveyor, and each of which is in a reservoir for the substance (e.g. electrostatic ink composition) to be concentrated (e.g. in step (a)). In some examples, the conveyor is in the form of a drum having a surface covering of a non-metallic, non-elastomeric material and the first electrode is in the form of a roller comprising a metal core having a surface covering of a non-metallic elastomeric material.

Moving Surface

The method may involve passing the substance (e.g. electrostatic ink composition) on the conveyor past the moving surface, wherein the substance (e.g. electrostatic ink composition) contacts the moving surface and a potential is applied between the conveyor and the moving surface, such that the particles are disposed to move toward the conveyor and some of the liquid carrier is removed to increase the concentration of the chargeable particles in the liquid carrier on the conveyor to form a concentrated substance (e.g. electrostatic ink composition) on the conveyor.

The moving surface forms the outer surface of a moving body, which may be in the form of a drum or belt, as described herein. The moving surface may form part of a drum or a belt, driven by rollers. The moving surface and the body of which it forms part are able to be biased, such that a potential can be applied between the moving surface and the conveyor. The moving surface may be considered to be part of a further electrode.

In some examples, the moving surface forms the outer surface of a rotatable drum. The drum having the moving surface may rotate on an axis, which may be orientated at any desired angle. In some examples, the axis of the drum having the moving the surface is on the horizontal. The drum having the moving surface may be any suitable shape, but in some examples is cylindrical, with the axis of rotation forming the axis of the cylinder.

In some examples, the moving surface forms the outer surface of a belt that is driven by a suitable mechanism, such as one or more rollers.

The moving body having the moving surface may comprise a metal. In some examples, the moving body having the moving surface may comprise a metal having a surface covering comprising an elastomeric material. For example, the moving body having the moving surface may comprise a drum having a metal core with an outer surface layer comprising an elastomeric material. The metal may be selected from, but is not limited to, steel, aluminium and copper. The surface covering or outer surface layer may comprise an elastomeric material and a resistivity control agent, which may be dispersed in the elastomeric material. The resistivity control agent may act to increase or decrease the resistivity of the elastomeric material (compared to the same material absent said resistivity control agent). The elastomeric material may comprise a material selected from chloroprene rubber, isoprene rubber, EPDM rubber, polyurethane rubber, epoxy rubber, butyl rubber, fluoroelastomers (such as the commercially available Viton) and polyurethane.

The resistivity control agent, which may be dispersed in the elastomeric material, may be selected from an ionic material, a metal or carbon. The ionic material may be a quaternary ammonium compound. The resistivity control agent, which may be dispersed in the elastomeric material, may be selected from organic dyes, organic pigments, organic salts, polyelectrolytes, inorganic salts, plasticisers, inorganic pigments, metallic particles, charge transfer complexes or materials which produce charge transfer complexes with the elastomeric material, e.g. polyurethane. The resistivity control agent may be present in an amount of 0.1 to 6 wt % of the surface covering, while the remaining wt percentage may be the elastomeric material. The resistivity control agent may be a quaternary ammonium compound, for example a compound of the formula (NR1'R2'R3'R4)X', in which $R^{1'}$ $R^{2'}$ $R^{3'}$ and $R^4$ are each independently hydrocarbon groups, including, but not limited to, alkyl or aryl groups, and wherein the alkyl is substituted or unsubstituted, branched or straight-chain, saturated or unsaturated, and X' is an anion, such as a halide. Examples of quaternary ammonium compounds include, but are not limited to, tetraheptyl ammonium bromide, trimethyloctadecylammonium chloride, benzyltrimethylammonium chloride. In some examples, the resistivity control agent is a lithium salt.

If the moving surface is a moving body comprising a drum having a metal core with an outer surface layer comprising an elastomeric material, the resistivity of the surface of the drum may be from $1\times10^5$ Ohm*m to $1\times10^8$ Ohm*m, in some examples $1\times10^6$ Ohm*m to $1\times10^7$ Ohm*m, when measured between the roller and a metal rod in contact, the total area of the contact along the roller of about 340 mm is about 1 cm.

In some examples the conveyor comprises a metal substrate, which may be in the form of a drum, having a surface covering of a non-metallic, elastomeric material, and the moving body having the moving surface comprises a metal substrate, which may be in the form of a drum, having a surface covering of a non-metallic, non-elastomeric material.

In some examples, the conveyor comprises a metal substrate, which may be in the form of a drum, having a surface covering of a non-metallic, non-elastomeric material, and the moving body having the moving surface comprises a metal substrate, which may be in the form of a drum, having a surface covering of a non-metallic material, which may be a non-metallic, elastomeric material.

In some examples, a plurality of moving surfaces are disposed around the conveyor. For example, the conveyor may comprises a first drum, and a plurality of second drums having a moving surface are disposed around the first drum. For example, the first conveyor may comprise a first drum, and at least two, in some examples at least three, in some examples at least four second drums having a moving surface are disposed around the first drum. The surface covering may have a resistivity of from 107 to 1011 ohm cm. The surface covering on the moving surface may have a thickness of from 0.001 mm to 20 mm, in some examples 0.05 mm to 10 mm, in some examples from 1 mm to 10 mm, in some examples 1 mm to 3 mm, in some examples 3 mm to 8 mm. The moving body having the moving surface may be constructed as described in the U.S. Pat. No. 3,863,603 (see description of the magnetic brush roll) and U.S. Pat. No. 3,959,574 (see description of the biasable transfer member), both of which are incorporated herein by reference in their entirety.

In some examples, a plurality of moving surfaces are provided in series at or near the outer surface of the conveyor. In some examples, each moving surface forms part of a moving body in the form of a rotatable drum. In some examples, the liquid carrier removed from the drum closest to the first electrode is recirculated to the first electrode, and at least some of the liquid carrier removed from the other drum or drums is passed between the second electrode and the conveyor in step (e) of the first aspect or step (d) of the second aspect. "In series" may indicate that the moving surfaces are arranged in series in the direction of travel of the conveyor, such that the concentrated substance on the conveyor passes each moving surface in turn.

In some examples, the surface of the conveyor and the moving surface travel at the same relative speed and in the same direction at the point where they are closest to one another. In the method, the surface of the conveyor and the moving surface may travel at a speed of from 1 to 100 cm/sec, in some examples 5 to 50 cm/sec, in some examples 20 to 50 cm/sec, in some examples 30 to 50 cm/sec in some examples 10 to 30 cm/sec.

In the method, a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated substance (e.g. electrostatic ink composition) on the conveyor. The potential applied between the conveyor and the moving surface may be less than that applied between the electrode and the conveyor. The potential applied between the conveyor and the moving surface may be in the range of from 300 to 4000 V, in some examples 300 to 2000V, in some examples 300 to 1500 V, in some examples 500 to 1200 V, in some examples from 600 to 1100 V, in some examples from 700 to 1000 V, in some examples from 800 to 900 V.

In some examples, the potential applied to the first electrode and/or the moving surface is −1000 V or less (more negative), with the potential applied to the conveyor being at a potential more positive than −500 V. In some examples, the potential applied to the first electrode and/or the moving surface is −1500 V or less (more negative), with the potential applied to the conveyor being at a potential more positive than −500 V. In some examples, the potential applied to the first electrode and/or the moving surface is −2000 V or less (more negative), with the potential applied to the conveyor being at a potential more positive than −500 V. In some examples, the potential applied to the first electrode and/or the moving surface is −2500 V or less (more negative), with the potential applied to the conveyor being at a potential more positive than −500 V. In some examples, the potential applied to the first electrode and/or the moving body is −2800 V or less, with the potential applied to the conveyor being at a potential more positive than −500 V, in some examples being 0V or more.

In some examples, the potential applied to the first electrode and/or the moving surface is 1000 V or more (more positive), with the potential applied to the conveyor being at a potential less positive than 500 V. In some examples, the potential applied to the first electrode and/or the moving surface is 1500 V or more (more positive), with the potential applied to the conveyor being at a potential less positive than 500 V. In some examples, the potential applied to the first electrode and/or the moving surface is 2000 V or more (more positive), with the potential applied to the conveyor being at a potential less positive than 500 V. In some examples, the potential applied to the first electrode and/or the moving surface is 2500 V or more (more positive), with the potential applied to the conveyor being at a potential less positive than 500 V. In some examples, the potential applied to the first electrode and/or the moving body is 2800 V or more, with the potential applied to the conveyor being at a potential less positive than 500 V, in some examples being 0V or less.

In some examples, after the concentrated substance (e.g. electrostatic ink composition) has been formed on the conveyor, the conveyor and the moving surface then diverge from one another, such that substantially all of the concentrated substance (e.g. electrostatic ink composition) remains on the conveyor. In some examples, "substantially all of the concentrated substance (e.g. electrostatic ink composition)" indicates that at least 90 wt %, in some examples at least 95 wt %, in some examples at least 99 wt %, of the particles in the concentrated substance (e.g. electrostatic ink composition) remain adhered to the conveyor. In some examples only a very small quantity, in some examples none, of the concentrated substance (e.g. electrostatic ink composition) is transferred to the moving surface. In some examples, "a very small quantity", indicates that 10 wt % or less, in some examples 5 wt %, in some examples 1 wt % or less of the particles in the concentrated substance (e.g. electrostatic ink composition) are transferred to the moving surface.

In some examples, neither the conveyor nor the moving surface is or is part of a photoimaging plate.

Stream of Gas

The method may further involve directing a stream of gas, e.g. air, at the substance (e.g. electrostatic ink composition) on the conveyor. In some examples, the method may further involve directing a plurality of streams of gas, e.g. air, at the substance (e.g. electrostatic ink composition) on the conveyor. A stream of gas may be directed at the substance (e.g. electrostatic ink composition) on the conveyor before, during and/or after it has contacted the moving surface. Accordingly, the stream of gas may be directed at the substance (e.g. electrostatic ink composition) on the conveyor before or after it has been concentrated or during the concentration step involving the moving surface. In some examples, a stream of gas is directed at the substance (e.g. electrostatic ink composition) on the conveyor 0 to 30° from an angle that is perpendicular to the surface of the conveyor on which the substance (e.g. electrostatic ink composition) is disposed. In some examples, a stream of gas is directed at the substance (e.g. electrostatic ink composition) on the conveyor 0 to 20°, in some examples 0 to 10 °, 0 to 5°, in some examples about 0° from an angle that is perpendicular to the surface of the conveyor on which the substance (e.g. electrostatic ink composition) is disposed. For example, if the conveyor comprises a drum in the form of a cylinder, during the method, the stream of gas may be directed toward the cylinder at an angle 0 to 30° from the radius of the cylinder.

In some examples, the stream or streams of gas may be produced by an air knife or a plurality of air knives.

The stream of gas, e.g. air, may have a moving gas speed of at least 50 m/s, in some examples at least 80 m/s, in some examples at least 100 m/s. The stream of gas, e.g. air, may have a moving gas speed of from 50 to 200 m/s, in some examples 80 to 150 m/s, in some examples from 100 to 120 m/s.

In some examples, the stream of gas has a temperature of less than 60° C., in some examples less than 50° C., in some examples less than 40° C., in some examples less than 30° C. In some examples, the stream of gas has a temperature of from 10° C. to 60° C., in some examples a temperature of from 15° C. to 50° C., in some examples a temperature of from 20° C. to 40° C., in some examples a temperature of from 20° C. to 30° C.

The stream of gas has been found to further concentrate the substance (e.g. electrostatic ink composition), without significantly affecting the integrity of resin particles that may be in the substance.

Second Electrode

In some examples, the method may involve passing at least some of the liquid carrier removed from the conveyor (e.g. in step (b) or step (c) in the first aspect) between a second electrode and the conveyor, and the liquid carrier may contain some chargeable particles. In some examples, the apparatus is adapted to pass at least some of the liquid carrier removed from the conveyor (e.g. in step (a) or step (b) in the second aspect) between a second electrode and the conveyor, and the liquid carrier may contain some chargeable particles.

In some examples, all of liquid carrier removed from the conveyor, for example at the first electrode, moving surface and second electrode, is recycled, for example to the first and second electrodes and passed between the conveyor and first electrode (e.g. at step (b) in the first aspect or or step (a) of the second aspect) and/or the conveyor and second electrode (e.g. at step (e) in the first aspect or or step (d) of the second aspect). The present inventors have found that some examples of the method and apparatus are capable of limiting or avoiding waste, and that the concentrated substance and liquid carrier collected at the end of the method are both suitable for reuse (e.g. with the integrity and properties of the chargeable particles substantially unaffected by the concentrating process and the liquid carrier having a very low solids content).

In some examples, a threshold limit may be set for the solids content (e.g. in wt % solids) in the liquid carrier removed from the conveyor, and liquid carrier removed from the conveyor (e.g. from the first electrode and/or moving surface) is passed to the second electrode if it is at or below the threshold limit and passed between the second electrode and the conveyor (e.g. in step (e) in the first aspect or step (d) in the second aspect). In some examples, any liquid carrier removed from the conveyor (e.g. from the first electrode and/or moving surface) having a solids content above the threshold limit is recirculated back to the first electrode and passed between the first electrode and conveyor (e.g. in step (b) of the first aspect or step (a) of the second aspect).

In some examples, a potential is applied between the conveyor and the second electrode such that the chargeable particles in the liquid carrier are disposed to move toward the conveyor, and some liquid carrier is removed, which has a lower solids content (e.g. in wt % terms) than the liquid carrier initially passed between the conveyor and first electrode.

The second electrode may comprise or be an electrode that is the same as the first electrode, for example in structure and/or materials, and/or a similar or the same potential is applied between the second electrode and the conveyor as between the first electrode and the conveyor.

The second electrode can be any suitable electrode capable of applying a potential between the conveyor and the second electrode. The second electrode may be stationary relative to the conveyor. The second electrode may have a shape that, at least in part, corresponds to the shape of at least part of the conveyor. For example, if the conveyor is a cylinder having an axis, the second electrode may have a cross section that forms part of a circle, the centre of this circle being the same as that for the cylinder. In some examples, if the conveyor is a cylinder having an axis, the second electrode may have an inner surface that forms part of a cylinder shape, the axis of this cylinder shape being the same as that for the cylinder of the conveyor.

In some examples, the second electrode is stationary relative to the conveyor, and is separated by a gap through which liquid carrier is passed, and in at least part of the region of the gap, has a shape that corresponds to the shape of the nearest surface of the conveyor. Fluid seals may be provided at the lateral edges of gap.

In some examples, a gap is provided between the second electrode and the conveyor, and the liquid carrier in step (e) in the first aspect (or step (d) of the second aspect) is fed into the gap in a direction substantially opposite to the direction of movement of the conveyor past the second electrode. This has been found to assist in filling the gap with liquid carrier. Additionally, when the liquid carrier has traveled along at least part of the second electrode in the direction substantially opposite to the direction of travel of the conveyor, its solids content has been found to be lowered to a low amount, since a large proportion of the chargeable particles in the liquid carrier has been found to adhere to the conveyor, and thus decrease the solids content in the liquid carrier.

In some examples, liquid carrier is collected after it has traveled at least part of, in some examples all of, the length of the second electrode in a direction opposite to the direction of movement of the conveyor past the second electrode. Liquid carrier collected from here has been found to have a very low solids content compared with the substance to be concentrated initially and the liquid carrier initially passed between the second electrode and conveyor.

In some examples, the gap between the conveyor and the second electrode has a first exit and second exit, out of both of which liquid carrier can flow after being passed into the gap, and the first exit is located downstream, in the direction of travel of the conveyor, from the second exit. In some examples, liquid carrier removed from the conveyor (e.g. in step (b) or step (c) in the first aspect or step (a) or (b) in the second aspect) is then passed into the gap downstream, in the direction of travel of the conveyor, from the second exit, and, in some examples, at or near the first exit. In some examples, liquid carrier that exits the gap at the first exit is recycled back to the first electrode, and passed between the first electrode and the conveyor (e.g. at step (a) in the first aspect). In some examples, liquid carrier that exits the gap at the second exit is transferred to a storage vessel. In some examples, the storage vessel is then sealed and the liquid carrier transported to and/or stored at a desired site. In some examples, the storage vessel may be a drum.

In some examples, the substance is an electrostatic ink composition comprising the chargeable particles in the liquid carrier.

In some examples, liquid carrier removed from the conveyor in step (b) or step (c) in the method is passed between a second electrode and the conveyor only if it has a solids content below a threshold value. This may be a predetermined threshold value and the apparatus may be capable of sensing the solids content of the liquid carrier removed from the conveyor in step (b) and/or step (c), and then directing the liquid carrier to the second electrode if it has a solids content below a threshold value.

In some examples, the shortest distance between the second electrode and the conveyor is from 0.5 mm to 5 mm, in some examples from 0.5 to 2 mm, in some examples from 0.8 mm to 1.2 mm.

In some examples, the second electrode may be in the form of a roller or a belt, having a surface that can move in the same direction as the surface of the conveyor, and may, in the absence of the substance or liquid carrier, contact the surface of the conveyor. If the second electrode is in the form of a roller, e.g. a cylinder, and the conveyor is in the form of a drum, the roller of the second electrode may have a diameter that is less than the diameter of a roller of drum of the conveyor. In some examples, a plurality of second electrodes in the form of rollers and/or belts, e.g. as described above, may be disposed around the conveyor, and, in use, each may be used to adhere the chargeable particles to the conveyor.

In some examples, a plurality of second electrodes are provided. The plurality of second electrodes may each individually and independently be selected from the types of second electrode described herein. In some examples, at least one of the plurality of electrodes is stationary relative to the conveyor and another of the plurality of electrodes is in the form of a roller or a belt, having a surface that can move in the same direction as the surface of the conveyor, and may, in the absence of the substance or liquid carrier, contact the surface of the conveyor. In some examples, a plurality of second electrodes are provided, in which one is stationary relative to the conveyor that is located upstream, in a direction of travel of the conveyor, from the another second electrode in the form of a roller or a belt, having a surface that can move in the same direction as the surface of the conveyor, and may, in the absence of the substance or liquid carrier, contact the surface of the conveyor. In some examples, the liquid carrier is fed first to the stationary second electrode, and, then on the conveyor liquid carrier is then passed to the second electrode in the form of a roller or a belt. In some examples, liquid carrier removed from the second electrode in the form of a roller or a belt is recycled or recirculated to the stationary second electrode, and passed between the stationary second electrode and the conveyor.

If the second electrode is in the form of a roller, e.g. a cylinder, and the conveyor is in the form of a drum, the roller of the second electrode may have a diameter that is less than the diameter of a roller or drum of the conveyor. In some examples, a plurality of second electrodes in the form of rollers and/or belts, e.g. as described above, may be disposed around the conveyor, and, in use, each may be used to adhere the particles comprising the resin to the conveyor.

The second electrode may comprise any electrically conducting material, including, but not limited to, a metal and carbon. The second electrode may comprise a metal selected from copper, aluminium and steel.

In the method, a potential is applied such that the particles in the liquid carrier in the region between the second electrode and conveyor become adhered to the conveyor. The potential difference between the conveyor and the second electrode may be 500 V or more, in some examples 1000 V or more, in some examples 2000 V or more, in some examples 3000 V or more, in some examples 3200 V or more, in some examples 3500 V or more, in some examples 3800 V or more, in some examples 4000 V or more. The potential difference between the conveyor and the second electrode may be from 500 V to 7000V, in some examples 1000 V to 7000 V, in some examples 3000 V to 6000 V, in some examples 3000V to 4000 V. The conveyor may be at a potential more positive than the second electrode or the conveyor may be at a potential less positive than the second electrode. In some examples, the potential of the conveyor may be at or close to, e.g. within 50 V of, ground (0 V).

The electric field between the conveyor and the second electrode may be 500 V/mm or more, in some examples 1000 V/mm or more, in some examples 1500 V/mm or more, in some examples 2000 V/mm or more, in some examples 2500 V/mm or more, in some examples, 2800 V/mm or more, in some examples 2900 V/mm or more, in some examples 3000 V/mm or more, in some examples, 3200 V/mm or more, in some examples 3500 V/mm or more, in some examples 3800 V/mm or more, in some examples 4000 V/mm or more. The electric field between the conveyor and the second electrode may be from 500 V/mm to 6000 V/mm, in some examples from 1000 V/mm to 6000 V/mm, in some examples from 1500 V/mm to 6000 V/mm, in some examples from 2000 V/mm to 6000 V/mm, in some examples from 2500 V/mm to 5000 V/mm, in some examples 2800 V/mm to 4700 V/mm, in some examples 2900 V/mm to 4600 V/mm, in some examples 2900 V/mm to 4500 V/mm, in some examples 2900 V/mm to 4200 V/mm. The present inventors have found that if the particles are passed through a high electric field, this promotes their charging, and fields of 3000 V/mm or more have been found to be particularly effective in promoting charging of the particles, even when the substance (e.g. electrostatic ink composition) lacks a charge director.

The second electrode may be positioned adjacent the conveyor, with a separation between the second electrode and conveyor forming a gap. The second electrode may be located at a position downstream, in the direction of travel of the conveyor, from the point at which the concentrated substance is removed from the conveyor, e.g. downstream from the concentrated substance removal means. The second electrode may be located at a position upstream, in the direction of travel of the conveyor, from the first electrode. The method may be such that the liquid carrier fills, at least partially, the gap between the conveyor and the second electrode, and the potential in step (b) is applied such that the chargeable particles in the liquid carrier become adhered to the conveyor.

In some examples, the second electrode comprises a roller, which is adjacent the conveyor, and in a reservoir for the liquid carrier that has been removed from the conveyor (e.g. from the first electrode or moving surface) and is to be passed between the second electrode and first conveyor. In some examples, the second electrode comprises a plurality of rollers, which are positioned adjacent the conveyor, and each of which is in a reservoir for the liquid carrier that has been removed from the conveyor (e.g. from the first electrode or moving surface) and is to be passed between the second electrode and first conveyor. In some examples, the conveyor is in the form of a drum having a surface covering of a non-metallic, non-elastomeric material and the second electrode is in the form of a roller comprising a metal core having a surface covering of a non-metallic elastomeric material.

Removing the Concentrated Substance

The method may involve removing the concentrated substance (which, in some examples, may be an electrostatic ink composition) from the conveyor, e.g. in step (d) or the first aspect or step (c) of the second aspect, and transferring it to a storage vessel. The removal may be by scraping the concentrated substance (e.g. electrostatic ink composition) from the surface of the conveyor. The scraping may be effected by placing a stationary member, e.g. a plate or blade, in close proximity to, in some examples in contact with, the surface of the conveyor. The plate or blade may extend across the whole width of the conveyor, said width typically being perpendicular to the direction of travel of the surface of the conveyor. The stationary member may comprise any suitable material, including, but not limited to a metal or plastic.

The storage vessel may be a suitable container for the substance (e.g. electrostatic ink composition). In some examples, the concentrated substance (e.g. electrostatic ink composition) is transferred to a storage container, which is then sealed. The sealed storage container containing the substance (e.g. electrostatic ink composition) can then be transported as desired, for example to another site, where the substance can be further used, e.g. if the substance is an electrostatic printing ink, printing may take place.

In some examples, where the substance is an electrostatic printing ink, the method may further involve, after producing the concentrated ink and transferring it to a storage vessel, in some examples transporting the ink to another site, then diluting it with a carrier medium to reduce the solids content in weight percent (for example from a solids content of 30 wt % or more, in some examples 40 wt % or more, to a solids content of 10 wt % or less, in some examples 5 wt % or less), and then using the ink in an electrostatic printing process.

The concentrated substance (e.g. electrostatic ink composition), at the end of step (c) and/or in step (d) of the method may comprise 30% by weight or more solids, in some examples 35% by weight or more solids, in some examples 40% by weight or more solids.

The electrostatic printing process may involve providing the concentrated substance (which may be in the form of an electrostatic ink composition), and if desired, adding a charge director to the substance and/or, diluting it with a carrier medium to reduce the solids content in weight percent (for example from a solids content of 30 wt % or more, in some examples 40 wt % or more, to a solids content of 10 wt % or less, in some examples 5 wt % or less):

forming a latent electrostatic image on a surface;

contacting the surface with the substance, such that at least some of the particles adhere to the surface to form a developed toner image on the surface, and transferring the toner image to a print substrate.

The surface on which the latent electrostatic image is formed may be on a rotating member, e.g. in the form of a cylinder. The surface on which the latent electrostatic image is formed may form part of a photo imaging plate (PIP). The contacting may involve passing the electrostatic ink composition between a stationary electrode and a rotating member, which may be a member having the surface having a latent electrostatic image thereon or a member in contact with the surface having a latent electrostatic image thereon. A voltage is applied between the stationary electrode and the rotating member, such that the particles adhere to the surface of the rotating member. This may involve subjecting the electrostatic ink composition to an electric field having a field gradient of 1000 V/cm or more, in some examples 1500 V/cm or more.

The developed toner image may transferred to a print substrate directly or by being first transferred to an intermediate transfer member. The intermediate transfer member may be a rotating flexible member, which is in some examples heated, e.g. to a temperature of from 80 to 160° C. The print substrate may be any suitable substrate. The substrate may be any suitable substrate capable of having an image printed thereon. The substrate may comprise a material selected from an organic or inorganic material. The material may comprise a natural polymeric material, e.g. cellulose. The material may comprise a synthetic polymeric material, e.g. a polymer formed from alkylene monomers, including, but not limited to, polyethylene and polypropylene, and co-polymers such as styrene-polybutadiene. The polypropylene may in some examples be biaxially orientated polypropylene. The material may comprise a metal, which may be in sheet form. The metal may be selected from or made from, for instance, aluminum (Al), silver (Ag), tin (Sn), copper (Cu), mixtures thereof. In some examples, the print substrate comprises a cellulosic paper. In some examples, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The print substrate is in some examples a cellulosic print substrate such as paper. The cellulosic print substrate is in some examples a coated cellulosic print substrate, e.g. having a coating of a polymeric material thereon.

An example of the apparatus and method will now be described.

FIG. 1 shows schematically an apparatus 100 for concentrating a substance, e.g. an ink for an electrostatic printing process, comprising chargeable particles in a liquid carrier. The apparatus comprises a chargeable conveyor in the form of a first drum 1, a first electrode 2 located below the drum 1, two second drums or rollers 3, a second electrode 4 located anticlockwise around the drum 1 from the first electrode 2, a scraper 5, and a storage vessel 6. FIG. 1 also shows a conveyor belt 7, a preparation tank 8, and receptacles 19, 25 and 30.

As can be seen, the electrode 2 is a stationary electrode 2 located below the drum 1. The stationary electrode has a curved surface that follows the surface of the drum, and a gap is present between the curved surfaces of the electrode 2 and the drum 1. The gap may be of an appropriate dimension, depending on the intended use of the apparatus. In some examples, the gap is about 0.5 mm to 2 mm.

The first drum 1 may be as described herein. In some examples, it has a core 1B of metal, e.g., aluminum, and a surface coating (also referred to herein as a surface covering) 1A of, for example, an anodized metal.

The surface of each of the second drums 3, in the absence of the substance, e.g. an ink for the electrostatic printing process, is in contact with the surface of the first drum 1. Each of the second drums 3 has a core 3B of a metal and a coating (also referred to herein as an outer surface layer) 3A of an elastomeric material, e.g., polyurethane, in which is, in some examples, dispersed a resistivity control agent, such as a quaternary amine.

As can be seen, the second electrode 4 is a stationary electrode located adjacent the drum 1 and anticlockwise around the drum from the first electrode 2. The stationary electrode 4 has a curved surface that follows the surface of the drum, and a gap is present between the curved surfaces of the electrode 4 and the drum 1. The gap may be of an appropriate dimension, depending on the intended use of the apparatus. In some examples, the gap is about 0.5 mm to 2 mm.

An air knife (not shown) may be located clockwise around from the second drums 3 and anticlockwise around from the scraper 5. The air knife may be orientated such that a stream of air is directed toward the surface of the drum 1 along the radius of the cylinder of the drum. In some examples a plurality of air knives may be located around the chargeable conveyor.

A scraper 5 in the form of a metal blade is biased against the first drum 1 by a biasing means, e.g. springs (not shown). A conveyor belt 7 is located below the scraper. A storage vessel 6 is located below one end of the conveyor belt 7.

An example of a use in the concentration of an electrostatic ink composition will now be described. In use, an ink for use in an electrostatic printing process is first prepared in preparation tank 8. On entering the preparation tank, the precursor ink composition typically has an amount of non-volatile solids of 20-25 wt %. Once the precursor ink composition has been subjected to final stages of preparation, involving addition of certain additives and further dilution of the ink composition to an amount of non-volatile solids of about 5% by weight, to form an ink composition for concentration, it is then fed to the first electrode 2 via conduit 9, which may be a pipe or other similar hollow member. A pump 10 is used to assist transfer of the ink composition from preparation tank 8 to the electrode 2. A potential V1 is applied to the electrode 2, a potential V2 is applied to the drum 3 located closest to electrode 2 in a clockwise direction, a potential V3 is applied to the drum 3 located further from the electrode 2 in a clockwise direction, and potential V4 is applied to the drum 1. The drums 3 both rotate in an anticlockwise direction, while the drum 1 rotates in a clockwise direction. The ink composition is fed to the electrode 2 at position shown by the end of conduit 9, and injected between the electrode 2 and the rotating drum 1 in a direction opposite to that of the rotating drum. This has been found to ensure that most, if not all, of the gap between the electrode 2 and the drum 1 is filled with the electrostatic ink composition. In the gap between the first electrode 2 and the drum 1, chargeable particles are disposed to move toward and adhere to the drum. Some of the liquid carrier will adhere to the drum with the particles, but some will flow out of the gap at the anti-clockwise side of the electrode 2 and some will flow out of the gap at the clockwise side of the electrode 2. The liquid carrier that flows out of the gap at the anti-clockwise side of the electrode 2 is collected in a right-hand side of collection tray 10*a*. The liquid carrier that flows out of the gap at the clockwise side of the electrode 2 is collected in a left-hand side of collection tray 10*a*. The right and left hand sides of collection tray 10*a* are separated from one another. It has been found that the liquid carrier exiting from the gap at the right hand side of the first electrode 2, i.e. having traveled the length of the electrode against the rotation of the drum 1, has a lower solids content than the liquid carrier exiting from the gap at the left hand side of the first electrode 2. Liquid carrier from the left hand side of the collection tray 10*a* is fed back to preparation tank 8 via conduit 13. Liquid carrier from the right hand side of the collection tray 10*a* is fed to a receptacle 19 via conduits 15 and 17. In some examples, a multi-way (e.g. a three-way) valve 16 may divert flow of liquid carrier coming from conduit 15 along conduit 18, instead of conduit 17, thus feeding the liquid carrier back to preparation tank 8; this may be desirable if the solids content of liquid carrier in the conduit 15 is above a threshold value, as will be explained below. In some examples, liquid carrier collected from the concentration process at electrode 2 and drums 3 is allowed to be transported to receptacle 19 for further cleaning at the second electrode 4 if it has a solids content below a certain threshold value.

As described above, when the ink composition in the gap between the electrode 2 and the drum contacts the drum, the potentials V1 and V4 are such that the particles in the ink composition move toward and adhere to the surface of the drum 1, together with some of the carrier liquid in which they are dispersed, to form a layer of ink on the surface of the first drum 1. The first drum 1 rotates clockwise, as shown by arrow A, such that the ink on the drum 1 moves toward a second drum 3. The second drum 3 rotates so the surface of the second drum 3 moves at the same speed as the surface of the first drum 1 at their point of contact. A potential V2 is applied to the first drum 1 and the second drum 3, such that the particles are drawn toward the first drum 1 and away from the second drum 3. The second drum 3 contacts the ink on the surface of the first drum and acts to remove some of the liquid carrier from the ink, while much, if not all, of solids remains adhered to the surface of the first drum 1, together with the remaining liquid carrier. This produces a concentrated ink on the surface of the first drum. The excess liquid carrier separated from the composition on the drum 1 during contact with drums 3 falls into collectors 11 and 12.

After having moved past the drum 3 closest to the electrode 2, the ink on the conveyor then moves toward and passes a further second drum 3. A potential V3 is applied between this further second drum 3 and the first drum 1, again such that the particles are drawn toward the surface of the first drum 1 and away from the further second drum 3. More of the liquid carrier in the ink is removed, further concentrating the ink on the surface of the first drum.

Collector 12 is located below the drum 3 located closest to the electrode 2. Liquid carrier is transported from the collector 12 back to the preparation tank 8 via the conduit 13. Collector 11 is located below the drum 3 located further from the electrode 2. Liquid carrier is transported from the collector 11 to the receptacle 19 via conduit 14. Liquid carrier collected in collector 12 is, in some examples, found to have a higher solids content than the liquid carrier collected in collector 11. In some examples, the liquid carrier collected in collector 11 has a solids content below a threshold value, allowing it to be transported to receptacle 19 for further cleaning at the second electrode 4.

After having moved past the drum 3 furthest from the electrode 2, the ink on the conveyor 1 may pass a stream of air produced by an air knife, which may serves to evaporate more of the liquid carrier, again further concentrating the ink on the surface of the first drum 1.

On further rotation of the drum 1, the concentrated ink then reaches the blade 5, which is urged against the surface of the first drum 1 by means such as springs.

The blade acts to scrape off the concentrated ink from the surface of the first drum 1. The blade is orientated so that the concentrated ink then slides downward toward a conveyor belt 7, which is turning clockwise, to transport the ink to a storage vessel 6 located below its right hand end. The storage vessel 6 may, for example, be a cartridge for transporting the ink composition. It can be transported to another site, e.g. a site having apparatus for electrostatic printing, and then used for this electrostatic printing. It can be diluted if desired by adding a liquid carrier, and then used in the electrostatic printing process.

The cleaning in the cleaning unit 101 of the excess liquid removed from the concentrating process at electrode 2 and drum 3 (via collector 11) will now be described. Liquid carrier transported to the receptacle 19 will typically have a lower solids content than that in the preparation tank 8. In some examples, a threshold solids content may be set, so that liquid carrier is transported to the receptacle 19 if the solids content is at or below this threshold, but may otherwise be re-circulated to preparation tank 8, and then back to the first electrode 2. The threshold may, in some examples, be around 1 wt % or less, in some examples around 0.5 wt % or less and in some examples 0.2 wt % or less. Liquid carrier collected in receptacle 19 is transported to the second electrode 4 via conduit 20, assisted by pump 10. The liquid carrier is fed into a gap between the second electrode 4 and the drum 1 at a location shown by the end of conduit 20. The liquid carrier is fed into the gap in a direction opposite to that of the direction of rotation of the drum 1. A potential V5 is applied to the second electrode 4, such that chargeable particles in the liquid carrier are disposed to move toward and adhere to the drum 1. Liquid carrier exits the gap between the electrode 4 and drum 1 either after it has travelled the length of the electrode 4 (against the rotation of the drum) at the uppermost part of the electrode 4 or near the location at which it was inserted into the gap at the lowermost part of the electrode 4. Liquid carrier exiting the gap at the lowermost part of the electrode is collected in collector 21 and fed back to receptacle via 19 conduit 22. In some examples, a further drum 3' is located clockwise around from the second electrode, the drum acting to further clean any ink/liquid carrier that may be present on the surface of the conveyor after it has past the second electrode. The drum 3' may have the same or similar construction to the two drums 3. Liquid carrier exiting the gap at the uppermost part of the electrode is collected in collector 23 and fed to receptacle 25 via conduit 24. The solids content has been found, in some examples to be very low, for example as low as 50 ppm solids, after it has exited the gap at the uppermost part of electrode 4. In some examples, if the solids content in the receptacle 25 is not as low as desired, the liquid carrier may be fed to receptacle 19 via conduit 26 for further cleaning. In some examples, if the solids content in the receptacle 25 is at or below a desired threshold, the liquid carrier may be fed to receptacle 30, which may be in the form of a drum for transportation, via conduit 27, valve 28 (which may be a float valve), and screening unit/filter 29 for use as desired.

In some examples, devices 31 are provided on or in the preparation tank 8, and/or any of receptacles 19 and 25, and the device may be able to monitor certain aspects within the preparation tank 8 and/or receptacles 19/25, including, but not limited to solids content of the substance/liquid carrier within the tank 8 and/or receptacles 19/25, temperature, pressure, and/or level of substance/carrier liquid within the tank 8 and/or receptacles 19/25.

While the methods and apparatus have been described with reference to certain examples, those skilled in the art will appreciate that various modifications, changes, omissions, and substitutions can be made without departing from the spirit of the disclosure. It is intended, therefore, that the methods and apparatus be limited by the scope of the following claims. The features of any dependent claim may be combined with the features of any of the independent or other dependent claims.

The invention claimed is:

1. A method for concentrating a substance, wherein the method comprises the steps of:

(a) providing the substance, the substance comprising chargeable particles in a liquid carrier;

(b) passing the substance between a conveyor and a first electrode, wherein a potential is applied between the conveyor and the first electrode such that the substance becomes adhered to the conveyor, and wherein some liquid carrier may be removed from the substance on the conveyor;

(c) passing the substance on the conveyor past a moving surface, wherein the substance contacts the moving surface and a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated substance on the conveyor, the conveyor and the moving surface then diverging from one another;

(d) removing at least some of the concentrated substance from the conveyor; and (e) wherein at least some of the liquid carrier removed from the conveyor in step (b) or step (c) is passed between a second electrode and the conveyor without being returned to a source of the substance, and a potential is applied between the conveyor and the second electrode such that the chargeable particles are disposed to move toward the conveyor, and some liquid carrier is removed.

2. The method according to claim 1, wherein the second electrode is stationary relative to the conveyor, and is separated therefrom by a gap through which liquid carrier is passed in step (e), and in at least part of a region of the gap, has a shape that corresponds to a shape of the nearest surface of the conveyor.

3. The method according to claim 1, wherein a gap is provided between the second electrode and conveyor, and the liquid carrier in step (e) is fed into the gap in a direction substantially opposite to the direction of movement of the conveyor past the second electrode.

4. The method according to claim 1, wherein a potential difference applied between the conveyor and the second electrode is 500 V to 6000 V.

5. The method according to claim 4, wherein the shortest distance between the second electrode and the conveyor is from 0.5 to 2 mm.

6. The method according to claim 1, wherein the substance is an electrostatic ink composition comprising the chargeable particles in the liquid carrier.

7. The method according to claim 1, wherein liquid carrier removed from the conveyor in step (b) or step (c) is passed between the second electrode and the conveyor if it has a solids content at or below a threshold value.

8. The method according to claim 1, wherein a plurality of moving surfaces are provided in series at or near an outer surface of the conveyor, and each moving surface forms part of a moving body in the form of a rotatable drum, and wherein the liquid carrier removed from the drum closest to the first electrode is recirculated to the first electrode, and at least some of the liquid carrier removed from the other drum or drums is passed between the second electrode and the conveyor in step (e).

9. The method according to claim 8, wherein each of the plurality of drums has a metal core with an outer surface layer comprising an elastomeric material.

10. The method according to claim 1, wherein the conveyor comprises a metal core having a surface covering of a non-metallic, elastomeric or non-elastomeric material.

11. The method according to claim 1, wherein the conveyor comprises an aluminium core, which has a Type III anodised surface covering.

12. The method according to claim 1, wherein the chargeable particles comprises a resin comprising a polymer that is a copolymer of ethylene or propylene and an ethylenically unsaturated acid of either acrylic acid or methacrylic acid.

13. An apparatus for concentrating a substance, the apparatus comprising a conveyor, a first electrode, a moving surface, a concentrated substance removal means, and a second electrode, wherein a gap is provided between the second electrode and the conveyor, and wherein the apparatus is adapted to carry out a method comprising the steps of:

(a) passing the substance between the conveyor and the first electrode, wherein the substance comprises chargeable particles in a liquid carrier, and a potential is applied between the conveyor and the first electrode such that the substance becomes adhered to the conveyor, and some liquid carrier may be removed from the substance on the conveyor;

(b) passing the substance on the conveyor past the moving surface, wherein the substance contacts the moving surface and a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated substance on the conveyor, the conveyor and the moving surface then diverging from one another, such that at least some of the concentrated substance remains on the conveyor;

(c) removing at least some of the concentrated substance from the conveyor by the concentrated substance removal means; and (d) wherein at least some of the liquid carrier that is removed from the conveyor in step (a) or step (b) is passed between the second electrode and the conveyor, wherein a potential is applied between the conveyor and second electrode such that the chargeable particles are disposed to move toward the conveyor, and some carrier liquid is removed, and wherein the apparatus can feed the liquid carrier in step (d) into the gap in a direction substantially opposite to the direction of movement of the conveyor past the second electrode.

14. A method for concentrating a substance, wherein the method comprises the steps of:

(a) providing the substance, the substance comprising chargeable particles in a liquid carrier;

(b) passing the substance between a conveyor and a first electrode, wherein a potential is applied between the conveyor and the first electrode such that the substance becomes adhered to the conveyor, and wherein some liquid carrier may be removed from the substance on the conveyor;

(c) passing the substance on the conveyor past a moving surface, wherein the substance contacts the moving surface and a potential is applied between the conveyor and the moving surface, such that the chargeable particles are disposed to move toward the conveyor and some of the liquid carrier is removed to increase the concentration of the chargeable particles in the liquid carrier on the conveyor to form a concentrated substance on the conveyor, the conveyor and the moving surface then diverging from one another; and (d) removing at least some of the concentrated substance from the conveyor;

wherein a gap is provided between a second electrode and the conveyor, and at least some of the liquid carrier removed from the conveyor in step (b) or step (c) is fed into the gap in a direction substantially opposite to the direction of movement of the conveyor past the second electrode, and a potential is applied between the conveyor and the second electrode such that the chargeable particles are disposed to move toward the conveyor, and some liquid carrier is removed.

15. The method according to claim 14, wherein liquid carrier is collected after it has travelled a length of the second electrode in a direction opposite to the direction of movement of the conveyor past the second electrode.

* * * * *